United States Patent [19]

Van Zanten

[11] 4,384,947

[45] May 24, 1983

[54] PREHEATING OF OIL SHALE PRIOR TO PYROLYSIS

[75] Inventor: Kenneth D. Van Zanten, Littleton, Colo.

[73] Assignee: Tosco Corporation, Los Angeles, Calif.

[21] Appl. No.: 291,360

[22] Filed: Aug. 10, 1981

[51] Int. Cl.[3] ..... C10B 53/06; C10G 1/00; C10G 1/02

[52] U.S. Cl. ..... 208/11 R; 201/31; 202/109; 202/111

[58] Field of Search ..... 208/11 R, 12; 201/31, 201/36; 202/109, 111, 150

[56] References Cited

U.S. PATENT DOCUMENTS

| | | | |
|---|---|---|---|
| 3,925,190 | 12/1975 | Whitcombe et al. | 208/11 R |
| 4,087,347 | 5/1978 | Langlois et al. | 208/11 R |
| 4,210,492 | 7/1980 | Roberts | 201/31 X |
| 4,226,699 | 10/1980 | Nutter | 208/11 R |

*Primary Examiner*—Delbert E. Gantz
*Assistant Examiner*—Glenn Caldarola
*Attorney, Agent, or Firm*—Poms, Smith, Lande & Rose

[57] ABSTRACT

A process for preheating oil shale in which the oil shale is partially preheated to 200° F. to 400° F. in a first lift pipe followed by final preheat to temperatures of between 400° F. and 650° F. in a second lift pipe. Hydrocarbons released from the oil shale in both the first and second lift pipes are incinerated in an incinerator/recuperator. In order to provide adequate incineration and combustion of the hydrocarbons released in the first, low temperature lift pipe, the entrainment gas or first gas stream is a low Btu gas preferably produced from conventional gasification of carbonaceous material. The low Btu entrainment gas along with released hydrocarbons is utilized as a fuel in the incinerator/recuperator and also may be utilized for other combustion applications in oil shale pyrolysis processing. In oil shale pyrolysis carried out with ceramic balls as heat exchange bodies, a portion of the low Btu entrainment gas is conveniently utilized to fuel the ball heater. The heat generated in the incinerator/recuperator, is utilized to preheat various process gases to thereby recover and recuperate the heating value of the hydrocarbons released during preheat.

25 Claims, 3 Drawing Figures

PREHEATING OF OIL SHALE PRIOR TO PYROLYSIS

BACKGROUND OF THE INVENTION

The present invention relates generally to processes for preheating oil shale to temperatures of about 550° F. prior to pyrolysis. More specifically, the present invention relates to the preheating of oil shale by entrainment in a series of dilute phase lift pipes having gas streams of gradually increasing temperatures.

The present invention is an improvement upon U.S. Pat. No. 3,925,190 issued to Whitcombe et al. on Dec. 9, 1975. The patent issued to Whitcombe discloses an oil shale preheating process in which a series of dilute phase vertical transfer lines or lift pipes are used to preheat crushed oil shale to a temperature of between about 400° F. to 650° F. The Whitcombe patent and the disclosure therein are hereby incorporated by reference.

The preheating process as disclosed in the Whitcombe patent involves the use of at least two lift pipes and preferably three lift pipes which are serially connected together. Initially, crushed raw shale is heated to about 200° F. by entrainment in a gas stream in the first lift pipe. The partially preheated shale is separated from the first lift pipe gas stream and passed to a second lift pipe where it is entrained in a hotter gas stream which raises the temperature of the oil shale to about 350° F. After heating in the second lift pipe, the oil shale is again separated from the gas stream and passed to a third and final lift pipe where it is entrained in an even hotter gas stream. As the oil shale is entrained and lifted up within the third lift pipe, it is heated to its final preheat temperature of about 550° F. This fully preheated oil shale is then separated from the gas stream in the third lift pipe and passed to a retort for pyrolysis.

The preheat process disclosed in the Whitcombe patent is designed for use in a pyrolysis system where the heat for pyrolysis is supplied by heat carrying bodies, such as ceramic balls, in a rotating retort. In this type of retorting process, the ceramic balls are heated in a ball heater, then transferred to the retort where they provide heat for pyrolysis with the cooled balls being passed back to the wall heater for reheating. The flue gas from the ball heater is a convenient hot entraining gas for use in the third lift pipe. This hot flue gas from the ball heater is typically at temperatures between about 1200° F. and 1400° F. As the partially preheated oil shale is contacted with this hot gas stream in the third lift pipe, a small amount of hydrocarbons, generally on the order of 500 to 1,000 ppm, are released from the oil shale in gaseous form and entrained in the flue gas. In order to prevent loss of the hydrocarbons originating from the oil shale, an incinerator is provided for combusting these entrained hydrocarbons after the flue gas stream is separated from the preheated oil shale in the third lift pipe. According to the Whitcombe patent disclosure, the incineration of the released hydrocarbons is carried out in an incinerator which is maintained at an incineration temperature of about 1400° F. by combustion of a liquid or gaseous fuel and air.

The hydrocarbon free flue gas generated in the incinerator, is passed upstream for use as the entraining gas in both the first and second lift pipes. In this way, a convenient process is provided for utilizing the 500 to 1,000 ppm of hydrocarbons generated in the third lift pipe while providing a source of hot entraining gas for the first and second lift pipes.

At the flue gas temperature present in the first and second lift pipes, between 75 and 100 ppm of hydrocarbons are generated or released from the oil shale in gaseous form. The amount of hydrocarbons released may even be greater when higher flue gas temperatures are utilized. In the Whitcombe patent disclosure, the flue gas from the first and second lift pipes is simply vented to the atmosphere with no provision being made for utilizing the hydrocarbons entrained in the flue gas. This not only lowers the net hydrocarbon yield of the process, but in addition is environmentally undesirable and limits the temperature of entraining gases in the first lift pipe to relatively low levels.

SUMMARY OF THE INVENTION

In accordance with the present invention, an improved oil shale preheat process is provided wherein the hydrocarbons released from partially preheated oil shale are utilized to increase net oil yields and are not vented to the atmosphere. The present invention not only reduces the hydrocarbon emissions from the preheat process, but also only requires two lift pipes to provide adequate preheating. Further, low Btu gas supplemented with the hydrocarbon emissions from the partially preheated oil shale is utilized to fuel the incinerator which is used to combust hydrocarbons emitted in the final preheat lift pipe.

The present invention is based on the utilization of two dilute phase lift pipe systems for preheating the oil shale in two stages. In the first stage or partial preheat stage, the raw oil shale is entrained in an oxygen free combustible gas. The raw oil shale is partially preheated in the first lift pipe to temperatures of between about 200° F. and 400° F. At these temperatures, the more volatile hydrocarbons present in the oil shale are vaporized and entrained in the combustible gas stream. The partially preheated oil shale is separated from the combustible gas stream and passed to the second lift pipe for further preheating. In processes where only partial preheating of the oil shale is desired, the partially preheated oil shale may be passed directly to the retort or other equipment for pyrolysis or further processing. The combustible gas stream, having hydrocarbons on the order of 1000 to 2000 parts per million, entrained therein may be utilized as a combustion fuel where necessary. In this way, the present invention provides for incineration or combustion of the hydrocarbons released at low or partial preheat temperatures as opposed to the undesirable venting of such hydrocarbons into the atmosphere.

The combustible gas stream for partially preheating the raw oil shale in the first lift pipe is conveniently provided by gasification of carbonaceous material such as auxiliary oil shale. Conventional gasification of oil shale with air and stream at temperatures of about 1,400° F. provides a low Btu combustible gas which is oxygen free. It is believed that the amount of hydrocarbons released in the first lift pipe from the entrained oil shale is related directly to the inlet gas temperature. Since the low Btu gas utilized in the first lift pipe in accordance with the present invention is at a relatively high temperature (1400° F.), the amount of hydrocarbons believed to be released is relatively large (i.e. 1000–2000 ppm as opposed to 75–100 ppm for the Whitcombe system); however, since the released hydrocarbons are entrained in the combustible gas stream and combusted therewith as a fuel, there is not as great a need to keep inlet gas temperatures low to prevent loss of hydrocarbons as in Whitcombe due to venting to the atmosphere.

In addition, since the low Btu gas stream in the first lift pipe does not contain oxygen, the potential for raw shale burning or clinkering in the first lift pipe is minimized. Further, due to the hydrogen and water vapor present in the low Btu gas produced from gasification of auxiliary oil shale, the specific heat of the low Btu gas (Cp=approximately 0.35 Btu/lb° F.) is higher than the specific heat of flue gas (Cp approximately 0.25–0.30 Btu/lb° F.). The high specific heat of the low Btu gas in combination with the high temperature (i.e. 1400° F.) provides sufficient heat transfer in a single conventional lift pipe to partially preheat the oil shale to the desired temperatures of 200° F. to 400° F. Final preheat to 550° F. is carried out in a second lift pipe. Therefore, the present invention provides preheating of the oil shale in two serially connected lift pipes as opposed to the three serially connected lift pipes which are preferred by the Whitcombe patent disclosure.

The partial preheating of oil shale in accordance with the present invention is particularly well suited for use in oil shale pyrolysis systems where the heat for pyrolysis is provided by circulation of hot heat carrying bodies. For example, in this type of process, ceramic balls are heated in a suitable ball heater. In order to provide the heat necessary to heat the balls within the ball heater, large amounts of fuel must be combusted with oxygen. As a feature of the present invention, a portion of the combustible gas stream separated from the first partial preheat lift pipe may be passed to the ball heater to provide part of the fuel necessary for heating the balls. The hot flue gas exiting the ball heater is conveniently used as the gas stream in the second lift pipe where the partially preheated oil shale is fully preheated to temperatures of between 400° F. and 650° F. As disclosed in the Whitcombe patent, the hot flue gas from the ball heater picks up from between 500 ppm to 1,000 ppm volatile hydrocarbon from the oil shale during the final preheat stage. In accordance with the present invention, these released hydrocarbon vapors are also combusted in an incinerator. As with the ball heater, fuel must be combusted to provide sufficient heat to the incinerator to combust and incinerate the hydrocarbons present in the gas stream removed from the second lift pipe. The low Btu gas which is removed from the first lift pipe may be used for providing the fuel necessary to heat the incinerator to desired combustion temperatures.

As a further feature of the present invention the low Btu gas with the hydrocarbons released from the oil shale therein may be utilized for other purposes at the pyrolysis processing plant. The two lift pipe system of the present invention when compared to the preferred three lift pipe system disclosed in the Whitcombe patent results in less capital investment, reduced operating costs, simplified operation and maintenance and improved reliability. Further, since the hydrocarbons generated in the partial or initial preheat lift pipe are combusted to supply heat for the process, there is a resulting net increase in production of liquid hydrocarbons.

These and many other features and attendant advantages of the present invention will become apparent as the invention becomes better understood by reference to the following detailed description when considered in conjunction with the accompanying drawings.

DETAILED DESCRIPTION OF A PREFERRED EXEMPLARY EMBODIMENT

Figure 1:
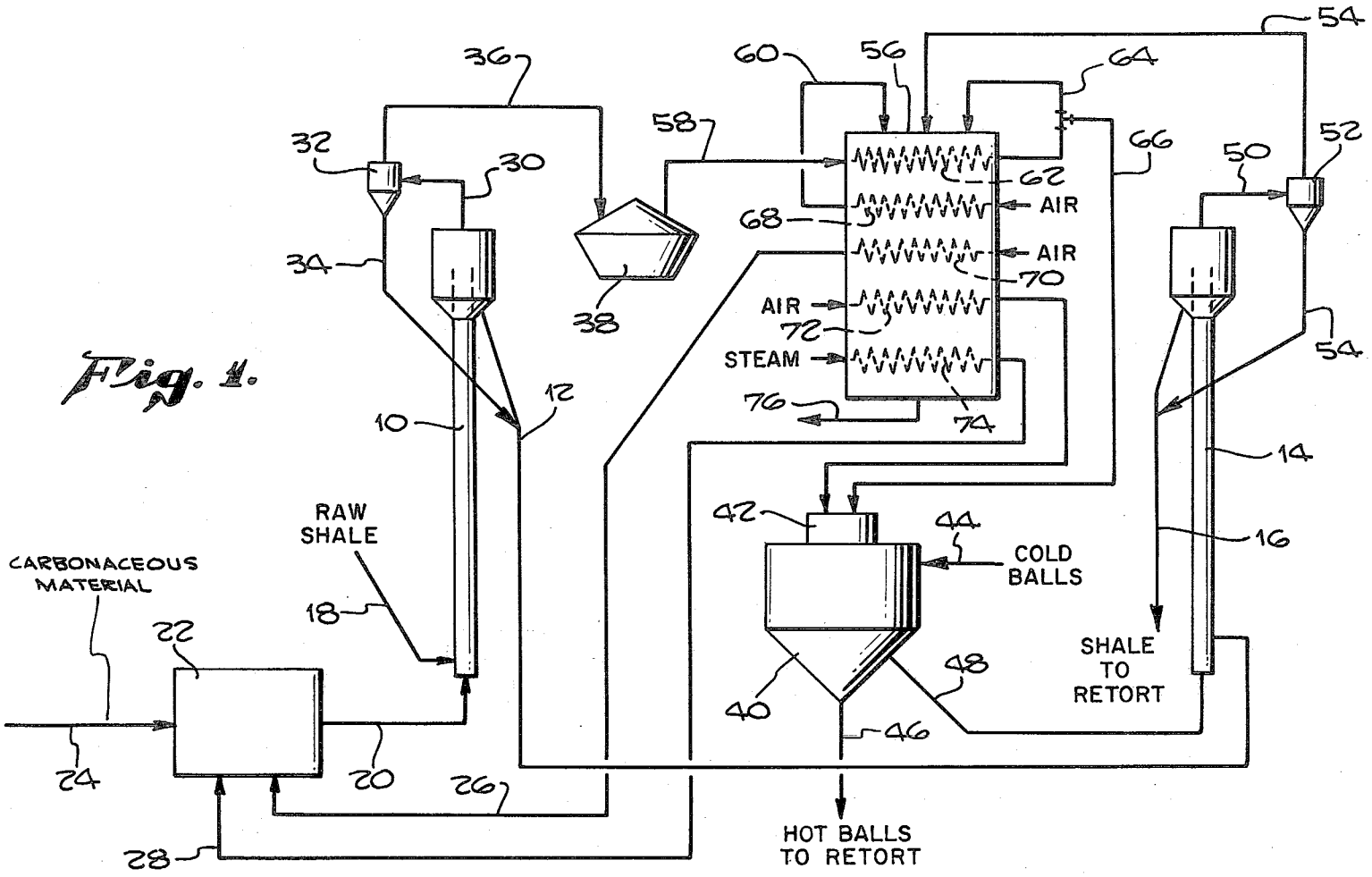
FIG. 1 is a simplified block diagram of a preferred exemplary oil shale preheat process and apparatus.

The present invention is shown diagrammatically in FIG. 1. A first lift pipe 10 is provided wherein raw oil shale is preheated to temperatures of between about 200° F. and 400° F. The partially preheated oil shale is then passed through line 12 to a second lift pipe 14 where the partially preheated oil shale is fully preheated to the desired preheat temperatures of 400° F. to about 650° F. The fully preheated oil shale is then passed through line 16 to a conventional oil shale pyrolysis retort for further heating and processing. When only partial preheating of the oil shale is desired, the partially preheated oil shale may be passed directly to the pyrolysis retort.

The raw shale to be processed or feed raw shale is introduced into the first lift pipe 10 through feed line 18. Preferably, the raw feed shale is crushed to minus ½ inch, so that it will be adequately entrained and lifted in the first lift pipe 10. The feed raw shale is entrained in a first gas stream which is introduced into the bottom of the lift pipe through gas line 20. In accordance with the present invention, the first gas stream is a combustible gas stream. The first gas stream preferably has a low Btu heating value between about 100 and 200 Btu/SCF (HHV). Although the low Btu combustible gas for the gas stream may be provided from any of a number of sources, it is particularly preferred that the low Btu gas stream be produced in gasifier 22 by gasification of carbonaceous material. The preferred carbonaceous material is raw oil shale. The gasifier 22 is a conventional pressurized fluid bed gasifier which is designed to gasify raw oil shale which is crushed to a particle size of minus ¼ inch. The raw oil shale which is introduced into the gasifier 22 will hereinafter be referred to as auxiliary oil shale. The auxiliary oil shale is introduced into gasifier 22 through auxiliary shale line 24. The particular type of oil shale utilized as feed oil shale or auxiliary oil shale may be the same except for size differences. The use of the terms feed oil shale and auxiliary oil shale is only used in this specification for identification purposes. The types of oil shale processed in accordance with the present invention is not critical.

Preheated air and preheated steam are passed into the gasifier 24 through air line 26 and steam line 28. The gasification within gasifier 22 is carried out conventionally resulting in the production of a low Btu gas having typically a heating value of about 130 Btu/SCF (HHV). This low Btu gas is oxygen free and contains hydrogen and water vapor. The gasifier is preferably operated at about 1,400° F. so that the low Btu gas introduced into the bottom of the first lift pipe 10 as the first gas stream is also at a temperature of about 1,400° F. The flow rate of the first gas stream is adjusted to provide suitable lifting and contact time of the raw oil shale to partially preheat the raw oil shale from about 50° F. to about 350° F. If desired, these initial partial preheat temperatures may be varied between 200° F. and 400° F.

At the temperatures present in the first lift pipe 10, and especially in view of the introduction of a relatively hot first gas stream at 1,400° F., the more volatile hydrocarbons present in the raw feed oil shale are vaporized. As previously stated, the amount of hydrocarbons vaporized at these temperatures is about 1000 to 2000 ppm. As the first gas stream passes up through the first lift pipe 10, it is cooled to a temperature of approximately 400° F. This cooled first gas stream with entrained oil shale fines and vaporized hydrocarbons is passed through exit line 30 to a cyclone separator 32. The partially preheated oil shale fines are returned to shale line 12 by way of return line 34. The first gas stream, which now contains hydrogen, water vapor and entrained hydrocarbons from the raw oil shale, is now passed through transfer line 36 to suitable separation and purification apparatus as represented at 38. The water vapor and any residual oil shale fines are removed from the first gas stream in the separation and purification apparatus 38. The separation and purification apparatus will be described in more detail below. The now purified low Btu gas which now contains hydrogen and entrained hydrocarbons is then ready for use in the preheat system as will also be described below.

In this exemplary embodiment, retorting of the preheated oil shale is accomplished in a conventional rotating retort using ceramic balls as the heat carrying and heat transfer material. A ball heater 40 is provided for heating the ceramic balls to the desired temperature for pyrolyzing the oil shale. The ball heater includes a combustion chamber 42 where fuel and air are combusted to provide the heat necessary to maintain a heater temperature of between about 1,200° F. and 1,400° F. After the ceramic balls have transferred heat to oil shale in the retort (not shown), these relatively cool ceramic balls are transferred to the ball heater 40 through line 44. The balls are heated to the desired temperature within the ball heater 40. These reheated ceramic balls are transferred back to the retort through line 46. The hot flue gas generated in the ball heater is conveniently utilized as the second gas stream for entraining and fully preheating oil shale in the second lift pipe. The ball heater flue gas, at a temperature of between about 1,200° F. and 1,400° F. is passed through line 48 to the bottom of the second lift pipe 14. Partially preheated oil shale at a temperature of between 200° F. and 400° F. is passed through line 12 from the first lift pipe and to the bottom of the second lift pipe 14 where it is entrained by the ball heater flue gas or second gas stream. The flue gas is preferably oxygen free to minimize oil shale burning and clinkering. The flow of ball heater flue gas through line 48 is regulated to provide a suitable entraining stream to preheat the already partially preheated oil shale entrained therein to a temperature of between about 400° F. and 650° F. Preferably, the oil shale is preheated to about 550° F.

At the temperatures present in the second lift pipe 14 and in view of the high temperature (1,200° F. to 1,400° F.) of the ball heater flue gas, hydrocarbons present in the oil shale are vaporized and released into the gas stream. The amount of hydrocarbons released is between about 500 ppm and 1,000 ppm. The second gas stream, having hydrocarbons and oil shale fines entrained therein is passed out of the second lift pipe 14 through exit line 50 to a cyclone separator 52 where the entrained fines are separated and returned to shale line 16 through return line 54. The second gas stream containing the entrained hydrocarbons is then passed from cyclone separator 52 through line 54 to the incinerator/recuperator 56.

The incinerator/recuperator 56 is provided to incinerate and combust the hydrocarbons present in the second gas stream and to recuperate or recover the heat thereby generated. The low Btu gas exiting the separation and purification apparatus 38 through line 58 is particularly well suited as a fuel for heating the incinerator 56 to temperatures necessary for the combustion of the hydrocarbons present in the second gas stream. The low Btu gas stream is passed through incinerator feed line 58 and into the incinerator 56 where it is combined with air introduced through line 60. Sufficient low Btu gas and air are provided in incinerator/recuperator 56 to maintain a temperature of about 1,400° F. The hydrocarbons and any oil shale fines present are combusted at this temperature in a residence time of between 0.3 and 1.0 seconds. In this way, the hydrocarbons present in the second gas stream and additionally the greater amount of hydrocarbons present in the first low Btu gas stream are combusted to provide heat and are thereby utilized advantageously.

The heat resulting from incineration and combustion of the first gas stream and hydrocarbons of the second gas stream is recovered or recuperated by transfer to various air and gas streams. Specifically, the low Btu gas stream in line 58 has been cooled during separation and purification to about 100° F. to 150° F. It is desirable that this low Btu gas be preheated to temperatures of about 400° F. prior to introduction into the incinerator/recuperator 56. The low Btu gas is passed through a heat exchanger such as coils 62 in the incinerator/recuperator 56. The low Btu gas is thereby preheated to the desired temperature while at the same time heat generated by the incinerator/recuperator 56 is partially recovered or recuperated and cycled back to the process. The preheated low Btu gas is then passed through line 64 to the incinerator/recuperator 56 for fueling combustion and through line 66 to the ball heater to provide fuel for heating the ceramic balls. Combustion air which is to be introduced into the incinerator/recuperator 56 is also desirably preheated to about 800° F. to 900° F. The incinerator/recuperator combustion air is also passed through a heat exchanger such as coils 68 in the incinerator/recuperator 56 to provide the desired preheating. Accordingly, air for introduction into the gasifier through line 26 may also be preheated in the recuperator/incinerator 56 by passage through coil 70 and combustion air for the ball heater 40 may also be preheated to desired combustion temperatures by passage through heat exchange coil 72 in the incinerator/recuperator 56. Finally, the steam which is introduced for gasification of auxiliary raw shale through line 28 may also be preheated to desired temperatures by passage through heat exchange coil 74 in the incinerator/recuperator 56. Although the recovery and utilization of heat from the incinerator recuperator 56 is preferably applied to preheating process gases, the heat generated in the incinerator/recuperator 56 may be recovered in any other convenient way if suitable means are available. The process gas preheat scheme shown in FIG. 1 is only the preferred system and the various particular process gases which are preheated in the incinerator/recuperator 56 may be varied according to particular system requirements and needs.

The partially cooled incinerator flue gas exits the incinerator recuperator 56 through line 76. This incinerator flue gas is then passed to further processing and cleanup as described below.

Figures 2, 3:
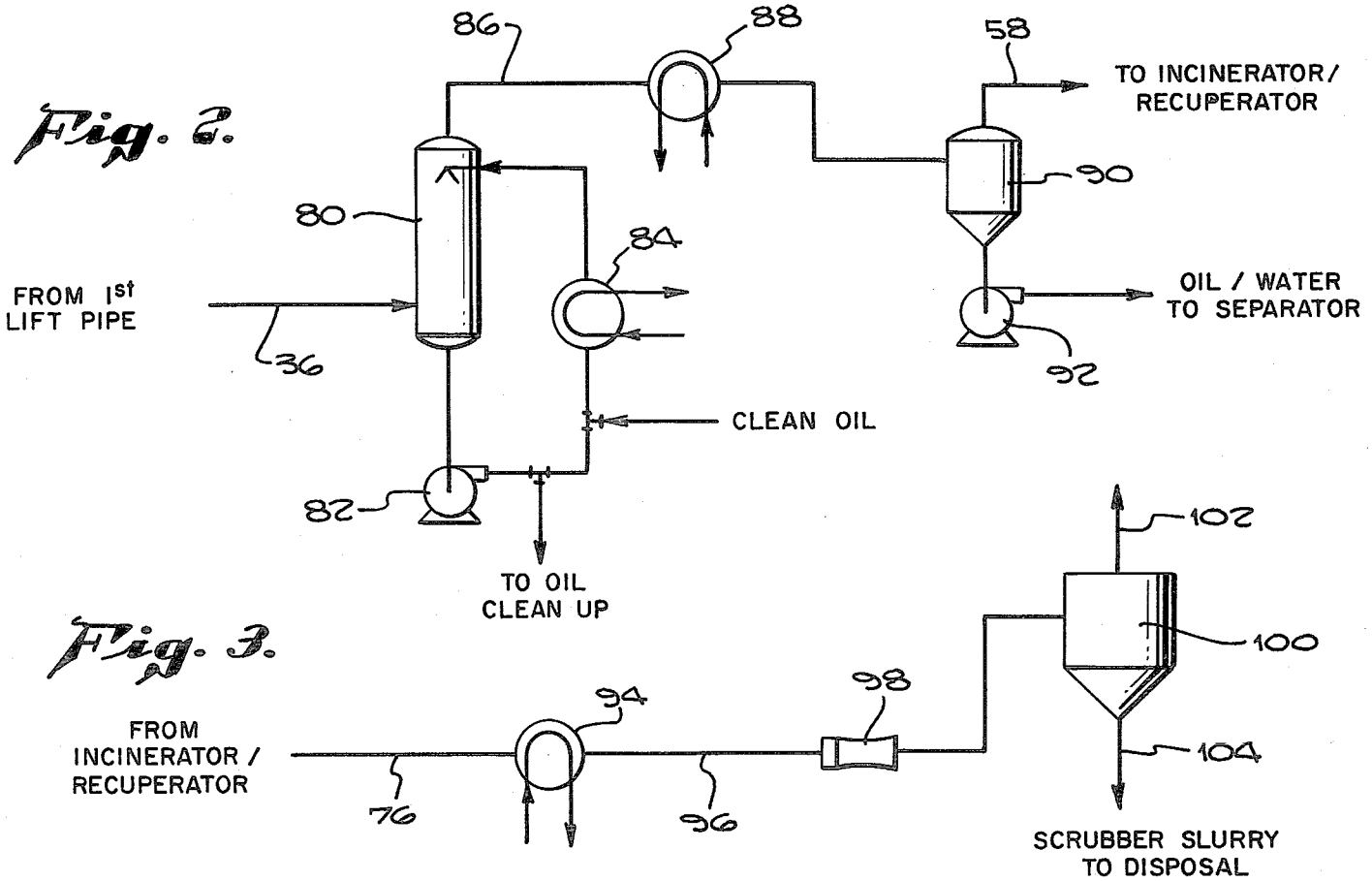
FIG. 2 is a detailed diagrammatic representation of the purification of the low Btu gas emitted from the first lift pipe prior to its use in the incinerator, ball heater or other combustion apparatus.
FIG. 3 is a detailed diagrammatic view of the downstream treatment of flue gas exiting the incinerator/recuperator.

Referring now to FIG. 2, a more detailed diagram of the separation and purification apparatus shown at 38 in FIG. 1 is depicted. The first gas stream in transfer line 36 is a low Btu gas which includes hydrogen, hydrocarbons, water vapor and some trace amounts of fines and other entrained material. In order to increase the heating value of the first gas stream or low Btu gas, it is desirable to remove any impurities and especially to remove as much water as possible. The separation and purification apparatus shown in FIG. 2 provides this separation. The wet low Btu gas is passed to oil scrubber 80. The low Btu gas is at a temperature of approximately 400° F. when it enters the oil scrubber. In the oil scrubber, the low Btu gas is passed through a series of oil sprays which remove any remaining raw shale and shale ash fines which were not previously removed by cyclone 32. The impure oil is removed from the bottom of the oil scrubber 80 by pump 82 and suitably filtered and cooled by passage through heat exchanger 84. The clean and cool oil is recirculated to the oil scrubber for continued scrubbing of the low Btu gas. The low Btu gas exits the oil scrubber through line 86 and is preferably at a temperature of about 200° F. to 250° F. or a temperature somewhat higher than the temperature where water vapor begins to condense. The gas stream is then passed through another heat exchanger such as overhead cooler 88 where it is cooled further to a temperature of near about 100° F. to 150° F. This relatively cool low Btu gas is passed to a water separation zone such as overhead condensate receiver 90. In the condensate receiver 90, the condensed water vapor is separated from the low Btu gas and is pumped from the condensate separator by pump 92. The relatively moisture free low Btu gas stream is then passed through line 58 for use as a fuel in the incinerator/recuperator 56, ball heater 40 or for use in other desired combustion apparatus and applications.

The diagram in FIG. 3 represents a preferred process for treating the flue gas which exits the incinerator/-recuperator 56 through line 76. First, the incinerator flue gas is cooled to 350° F. to keep it above the $SO_2$ acid dew point in a suitable heat exchanger such as cooler 94. The partially cooled incinerator flue gas is then passed through line 96 to a venturi wet scrubber 98 to remove shale dust. A slurry of shale ash and water is used in the wet scrubber 98 to remove sulfur dioxide produced from burning of the low Btu gas which contains hydrogen sulfide and other sulfur compounds and sulfur dioxide generated during preheating of the raw shale. Preferably, a portion of the shale ash produced during gasification in gasifier 22 may be used to make the shale slurry. The flue gas slurry mixture is removed from the venturi wet scrubber 98 and passed to a scrubber separator 100. The separator 100 separates the now clean flue gas from the shale ash slurry. The clean and purified flue gas is then vented to the atmosphere through line 102. The separated shale ash slurry is passed to disposal through line 104. The above described process for treating flue gas exiting the incinerator/recuperator 56 is only a preferred treatment process. Many other treatment systems to remove sulfur compounds and other contaminants are possible.

Having thus described an exemplary embodiment of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. A process for partially preheating oil shale to a temperature of between about 200° F. and 400° F. comprising:

entraining raw oil shale in a substantially oxygen free combustible gas stream having a sufficient temperature to raise the temperature of said raw oil shale to between about 200° F. and 400° F. to form partially preheated oil shale and a partially cooled combustible gas stream having hydrocarbons released from the oil shale entrained therein;

separating the partially preheated oil shale from the partially cool gas stream;

transferring the separated partially preheated oil shale to apparatus for further preheating and pyrolysis; and utilizing said first gas stream as a combustion fuel whereby said hydrocarbons released from said raw oil shale entrained therein are combusted with said partially cooled gas stream and not vented to the atmosphere.

2. A process according to claim 1 wherein said combustible gas stream is a low Btu gas produced by gasification of carbonaceous material.

3. A process according to claim 2 in which said carbonaceous material is auxiliary oil shale.

4. A process for preheating oil shale to a temperature of between about 400° F. and 650° F. comprising the steps of:

entraining raw feed oil shale in a low Btu gas to partially preheat said raw feed oil shale to a temperature of between about 200° F. to 400° F.;

separating said partially preheated feed oil shale from said low Btu gas said low Btu gas having hydrocarbons entrained therein;

entraining said partially preheated feed oil shale in a hot preheat gas stream to preheat said partially preheated feed oil shale to a temperature of between about 400° F. and 650° F.;

separating the preheated feed oil shale from the hot preheat gas stream to form preheated oil shale and preheat flue gas, said preheat flue gas containing hydrocarbons released from said feed oil shale;

passing said flue gas and said low Btu gas to an incineration zone; and adding sufficient combustion air to said incineration zone to combust the low Btu gas and the hydrocarbons in said low Btu gas and said preheat flue gas to form a substantially hydrocarbon free waste gas and combustion heat.

5. A process according to claim 4 wherein auxiliary raw oil shale is gasified to produce said low Btu gas.

6. A process according to claim 5 wherein said gasification of auxiliary raw oil shale is carried out in a pressurized fluid bed gasifier to produce a low Btu gas having a temperature of between about 1300° F. and 1500° F.

7. A process according to claim 6 wherein the low Btu gas has a heating value of between about 100 and 150 Btu/SCF (HHV).

8. A process according to claim 5 wherein said hot preheat gas stream is at a temperature of between about 1300° F. and 1500° F. when said partially preheated feed oil shale is entrained therein.

9. A process according to claim 8 wherein said hot preheat gas stream is at least in part provided by the flue gas from a ball heater for heating heat carrying solids.

10. A process according to claim 5 wherein a portion of said low Btu gas is combusted with combustion air in said ball heater to heat said heat carrying solids.

11. A process according to claim 5 wherein said low Btu gas contains water and said water is separated therefrom prior to introduction into said incineration zone to provide a moisture free low Btu gas.

12. A process according to claim 11 wherein water is separated from said low Btu gas by cooling said low Btu gas to below 150° F. and separating said condensed water therefrom to form a cooled moisture free low Btu gas.

13. A process according to claim 12 wherein said cooled moisture free low Btu gas is heated prior to introduction into said incineration zone to a temperature of about 400° F.

14. A process according to claim 13 wherein said moisture free cooled low Btu gas is heated with said combustion heat prior to introduction into said incineration zone.

15. A process according to claim 10 wherein at least a portion of said combustion heat is used to preheat said combustion ball heater combustion air and said incinerator combustion air to temperatures of about 800° F. to 900° F.

16. A process according to claim 5 wherein sufficient low Btu gas and combustion air are combusted in said incineration zone to maintain a zone temperature of about 1400° F.

17. A process according to claim 4 wherein the substantially hydrocarbon free waste gas is further treated to remove sulfur and entrained fines prior to venting to the atmosphere.

18. In a process for preheating raw oil shale wherein the raw oil shale is first partially preheated to a temperature of about 200° F. to 400° F. by entrainment in a first gas stream and wherein the partially heated oil shale is separated from the gas stream for further preheating and pyrolysis and wherein said separated gas stream which contains hydrocarbons released from said partially preheated oil shale is vented to the atmosphere, the improvement comprising:

entraining said oil shale in a combustible gas stream having a sufficient temperature to heat said oil shale to about 200° F. to 400° F.; and utilizing said combustible gas stream after separation from said partially preheated oil shale as a combustion fuel whereby said hydrocarbons released from said oil shale into said combustible gas stream are combusted with said gas stream and not vented to the atmosphere.

19. In a staged preheating process for preheating oil shale, wherein raw feed oil shale is initially entrained in a first gas stream to partially preheat the feed oil shale to temperatures of between about 200° F. to 400° F., said partially preheated feed oil shale being separated from said first gas stream and entrained in a second gas stream to preheat the feed oil shale to temperatures of between about 400° F. and 650° F., said preheated feed oil shale being separated from said second gas stream and passed to a retort for pyrolysis, and wherein said first gas stream contains hydrocarbons released from said feed oil shale and said second gas stream contains hydrocarbons released from said feed oil shale, said preheating process further including combustion in an incineration zone of said hydrocarbons in said second gas stream after separation from said preheated spent shale with said first gas stream being vented to the atmosphere; wherein the improvement comprises:

providing a first gas stream having a low Btu heating value for entraining said raw feed oil shale to partially preheat the feed oil shale; and separating the low Btu first gas stream from said partially preheated feed oil shale, said first gas stream containing said hydrocarbons released from the feed oil shale; and combusting said first gas stream to provide heat whereby said hydrocarbons in said first gas stream are not vented to the atmosphere.

20. In a staged oil shale preheat apparatus having a series of connected lift pipes for serially preheating oil shale to temperatures of between 400° F. and 650° F. by entrainment in hot gas streams, wherein one or more lift pipes are provided for partially preheating the oil shale to temperatures of between 200° F. and 400° F. and wherein means are provided for separating the partially preheated oil shale from the partial preheat entraining gas stream and venting said gas stream to the atmosphere, said gas stream including entrained hydrocarbons released from said oil shale and wherein means are provided for transferring the partially preheated oil shale to further preheating wherein the improvement comprises:

means for producing a substantially oxygen free combustible gas;

means for introducing said combustible gas as said partial preheat entraining gas stream in said partial preheat lift pipes;

means for separating said combustible gas with hydrocarbons entrained therein from said partially preheated oil shale; and means for combusting said combustible gas to incinerate said entrained hydrocarbons whereby said hydrocarbons are not vented to the atmosphere.

21. An improved apparatus according to claim 20 wherein said means for producing a substantially oxygen free combustible gas includes gasifier means for gasifying carbonaceous material to form a low Btu gas containing hydrogen and water.

22. An improved apparatus according to claim 21 wherein means are provided for separating water from said low Btu gas prior to combustion thereof to form a substantially dry low Btu gas.

23. An improved apparatus according to claim 22 wherein means are provided for combusting at least a portion of the dry low Btu gas, with said released hydrocarbons entrained therein, in a ball heater adapted to heat ceramic balls which are used as the heat transfer medium in oil shale pyrolysis.

24. An improved apparatus according to claim 22 wherein means are provided for combusting at least a portion of the dry low Btu gas, with said released hydrocarbons entrained therein, in an incinerator to incinerate hydrocarbons in flue gases vented from other higher temperature lift pipes in the preheat apparatus which are introduced into said incinerator.

25. A process according to claim 1 wherein said partially preheated oil shale is further preheated to a temperature of between about 400° F. to 600° F. after separation from said partially cooled gas stream.

* * * * *